US005317372A

United States Patent [19]

Nakabayashi et al.

[11] Patent Number: 5,317,372

[45] Date of Patent: May 31, 1994

[54] COPYING METHOD AND APPARATUS

[75] Inventors: Masayoshi Nakabayashi, Wakayama; Manabu Matsumoto, Nara, both of Japan

[73] Assignee: Sharp Kabushiki Kaisha, Osaka, Japan

[21] Appl. No.: 996,645

[22] Filed: Dec. 24, 1992

[30] Foreign Application Priority Data

Dec. 26, 1991 [JP] Japan ..... 3-345180

[51] Int. Cl.[5] ..... G03G 15/00

[52] U.S. Cl. ..... 355/311; 271/35; 271/111; 271/233; 271/291; 271/301; 355/308; 355/320; 355/321

[58] Field of Search ..... 355/308, 311, 316, 318, 355/320, 321, 23, 24, 208, 309; 271/35, 111, 233, 301, 291

[56] References Cited

U.S. PATENT DOCUMENTS 3,499,710 3/1970 Sahley ..... 355/271 X
4,179,215 12/1979 Hage ..... 355/313 X
4,553,828 11/1985 Burger et al. ..... 355/318
4,739,983 4/1988 Ide et al. ..... 271/233
4,825,248 4/1989 Honjo et al. ..... 271/111 X
5,120,039 6/1992 Yamada ..... 355/308 X
5,203,554 4/1993 Suzuki et al. ..... 271/291 X

OTHER PUBLICATIONS

*IBM Technical Disclosure Bulletin*, vol. 18, No. 2, Jul. 1975, "Dynamic Sheet Length Sensing", W. E. Church, J. D. Froula, (Copy in 355/311).

*Primary Examiner*—Matthew S. Smith

[57] ABSTRACT

In a document feeder, documents are contained on a document rest in a stacked state. These documents are sequentially transported to a specified exposure region on a table glass member of a copying machine by a feeder and transporter and are then exposed. The documents are then discharged again onto the document rest. The documents are thereby circulated for copying. When the documents are small in number, the documents are not discharged until a copying operation of a necessary number of sheets is completed, and the documents are moved back and forth for exposure between a transport path of the feeder and the transporter. This design enables the time required for copying a small number of documents to be shortened.

8 Claims, 12 Drawing Sheets

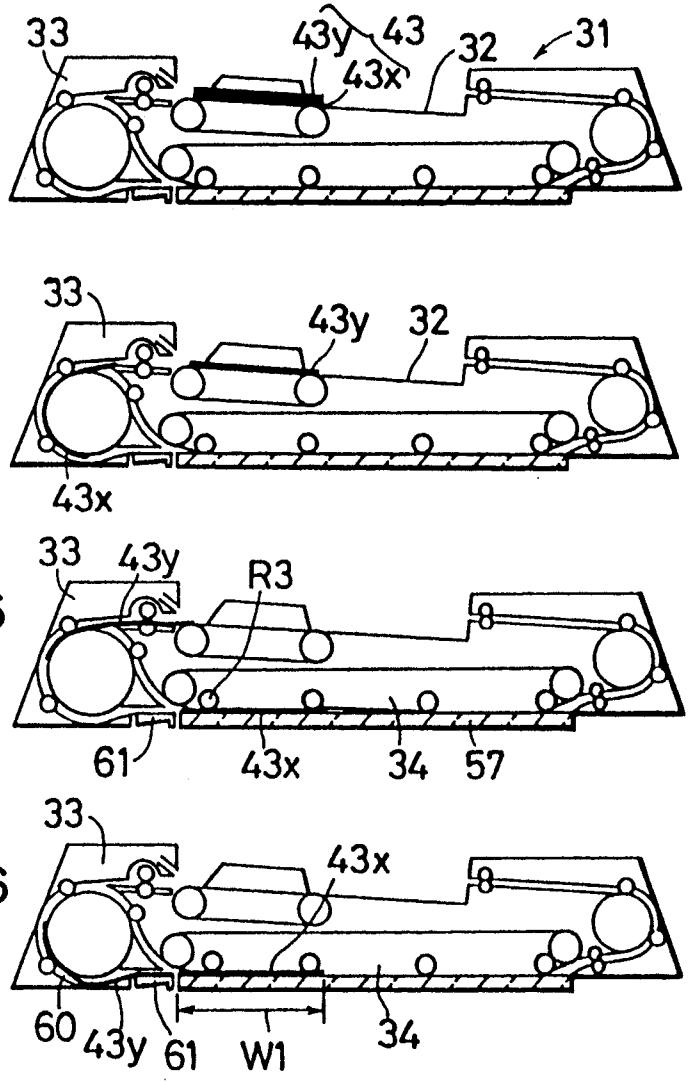
Fig. 6 (A)
Fig. 6 (B)
Fig. 6 (C)
Fig. 6 (D)
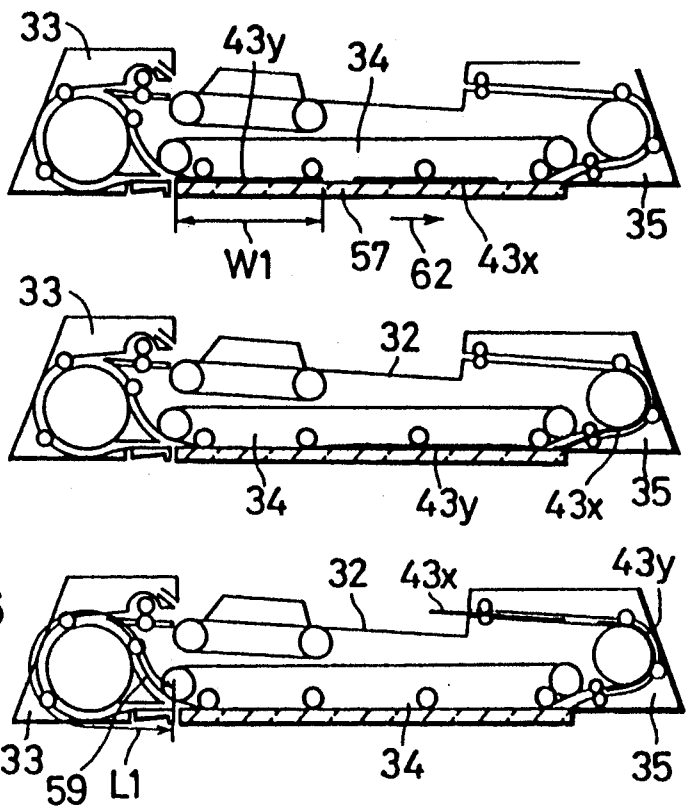
Fig. 6 (E)
Fig. 6 (F)
Fig. 6 (G)

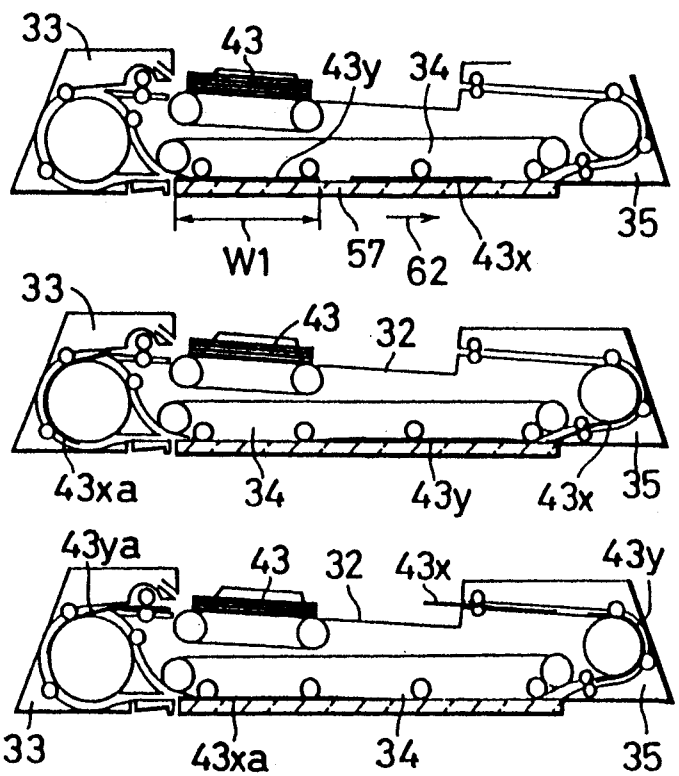
Fig. 9 (E)
Fig. 9 (F)
Fig. 9 (G)
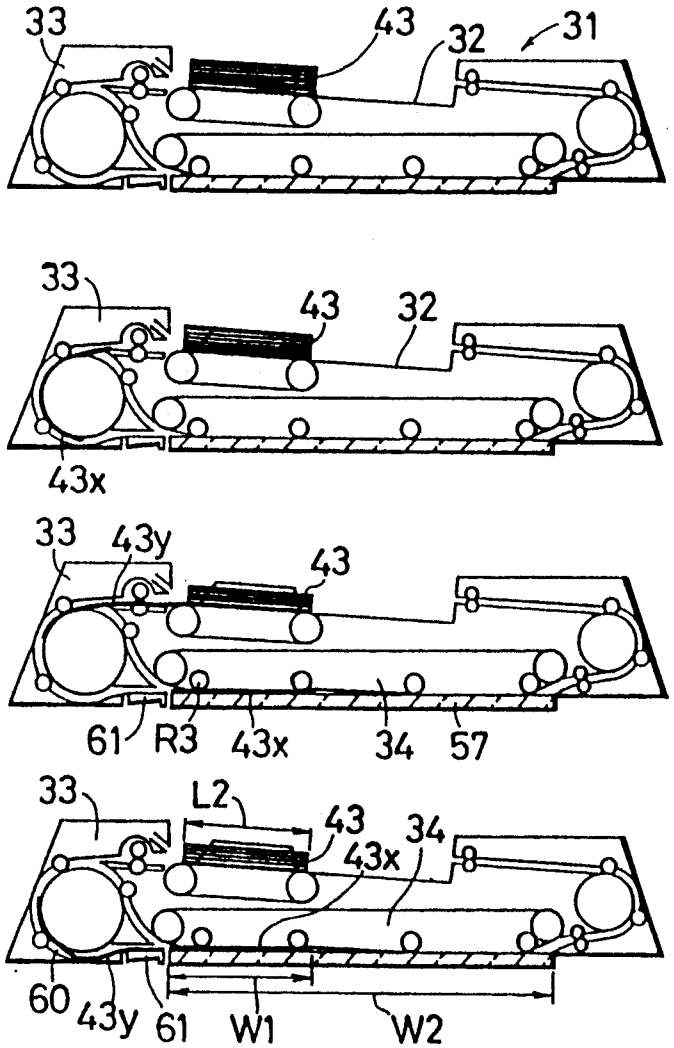
Fig. 9 (A)
Fig. 9 (B)
Fig. 9 (C)
Fig. 9 (D)

COPYING METHOD AND APPARATUS

BACKGROUND OF THE INVENTION

1. Field of the Invention

This invention relates to a copying method and apparatus using a recirculating document feeder, abbreviated as RDH, which enables exposure by sequentially taking out documents contained in a stacked state in means for containing.

2. Description of the Related Art

A copying machine is recently provided with a document feeder to feed documents sequentially to an exposure region in order to copy a plurality of sheet-like documents of a size efficiently. Also by repeating such copying operation a plurality of times, a plurality of sets of copies can be made arranged in the same order as documents. A typical prior art device for obtaining a plurality of copies is shown in U.S. Pat. No. 3,499,710 in FIG. 1 and U.S. Pat. No. 4,179,215 in FIG. 2.

FIG. 1 is a schematic sectional drawing of a document feeder 1 of the typical prior art. In the document feeder 1, document containers 4 and 5 are situated on both sides of a exposure region 3 of a copying machine main body 2. These document containers 4 and 5 are constructed in the same manner, and in the state shown in FIG. 1. A plurality of documents 7 are stacked and contained in main body 6 of the document container 4 which is on document feeding side. The documents 7 are pressed toward a bottom plate 6*a* of the main body 6 by spring force of a spring member 8*a* from above via a pressing plate 8. In the vicinity of the bottom plate 6*a* of a main body 6, a discharge port 9 is formed directed to the exposure region 3, and when a discharge roller 10 provided for the bottom plate 6 is driven, the documents in the bottommost layer are discharged through the discharge port 9. The documents 7 discharged through the discharge port 9 are sent onto a platen 13 composing the exposure region 3 through means for guiding 11, and transported to a predetermined exposure position suitable for the size of the documents 7 by means for transporting 12 realized by a transport belt or the like.

After the image of the documents 7 is copied onto a copy sheet, the documents 7 are thrown into an input port 15 of an other document container 5 on document containing side from the transporting means 12 through means for guiding 14. The input port 15 is formed above the level of the discharge port 9, and in the document container 5 on document containing side, the pressing plate 8 is displaced upward of the input port 15 against spring force of the spring member 8*a* by means for raising and lowering 16 realized by an electromagnetic plunger or the like.

Accordingly, the documents taken out from the bottom side of the document container 4 are thrown into the input port 15 of the document container 5 sequentially after exposure is made, therefore the documents 7 are contained in the document container 5 in the same order as when the documents were contained in the document container 4. When copying operation by the documents 7 in the document container 4 is all finished, the guiding means 11 connects the input port 15 of the document container 4 and the transporting means 12, the guiding means 14 connects the discharge port 9 of the document container 5 and the transporting means 12, further each pressing plate 8 in the document container 4 and 5 is raised and lowered respectively, and copying operation described above is made with the documents 7 from the document container 5. By moving the documents 7 back and forth in this way between the document container 4 and the document container 5, a necessary number of copies can be made in the same order as the documents 7.

On the other hand, the construction having the two document containers 4 and 5 occupies a large installation space, therefore a recirculating document feeder 21 is put into practical use wherein a single document container 22 is provided as shown in FIG. 2 and the documents 7 taken out of the document container 22 are returned to the document container 22. In this recirculating document feeder 21, the documents 7 are taken out sequentially from the bottommost layer through a discharge port formed on a bottom plate 23*a* of a main body 23 of the document container 22 by a discharge roller 24, transported onto a platen 27 of a copying machine body 26 by means for transporting 25 and exposed, sent from the transporting means 25 via means for guiding 28, then thrown in from above the main body 23 of the document container 22. The documents 7 are thus sequentially taken out from the bottommost layer and exposed, then the documents 7 are stacked in the uppermost layer, and such operation is repeated to make a plurality of sets of copies in the same order as that of the documents.

In the document feeding apparatus 1 constructed as described above, when copying of a few number of documents 7 is attempted in the same way as a large number of documents, feed of the documents for next copying operation can be restarted only after the documents are exposed and transported from the document container 4 on one side to the other side, i.e., the document container 5, then the guiding means 11 and 14 are driven to switch the discharge port 9 and the input port 15 as well as the raising and lowering means 16 is driven to vertically displace the pressing plate 8, which takes time.

Also in the recirculating document feeder 21 in FIG. 2, when the documents 7 are few, the guiding means 28 is sprung up as shown by a reference mark 28*a*, and the documents 7 are contained temporarily in the transporting means 25 without the documents 7 being returned to the document container 22. However, it still takes time since the length of a transporting path does not change much when the size of the documents 7 is small or the documents are small in number.

SUMMARY OF THE INVENTION

It is an object of the present invention to provide a copying method and apparatus using a document feeder which enables copying a small number of documents efficiently in a short time.

The copying method according to the invention, in order to attain the object mentioned above, in a copying method using a document feeder comprises the steps of:

containing documents in a container in a stacked state in a predetermined order;

supplying documents stacked in the container from one of an uppermost layer or a bottommost layer sequentially one by one and transporting the documents to an exposure region;

discharging documents after exposure from the exposure region to the other of the uppermost layer or the bottommost layer and stacking the documents in the predetermined order; and controlling the steps of supplying and discharging interlocked with copying operation;

wherein the documents are taken out, exposed, and discharged in a circulating manner to enable copying of a plurality of documents in the predetermined order, the method further comprising the step of detecting the length of the documents at least in transport direction, wherein during the step of controlling means, in response to a detection result during the step of detecting, when the sum of length of documents to be copied in the transport direction is below a predetermined length, the documents are moved back and forth in a transport path for repeating copying without discharging the documents to be copied.

Also the copying method according to the invention, in a copying method using a document feeder provided with an invertor which inverts the faces of a copy sheet to enable copying on both faces of the copy sheet comprises the steps of:

containing documents in a container in a stacked state in a predetermined order;

supplying documents stacked in the containing from one of an uppermost layer or a bottommost layer sequentially one by one and transporting the documents to an exposure region;

discharging documents after exposure from the exposure region to the other of the uppermost layer or the bottommost layer and stacking the documents in the predetermined order; and controlling the steps of supplying and discharging interlocked with copying operation;

wherein the documents are taken out, exposed, and discharged in a circulating manner to enable copying of a plurality of documents in the predetermined order.

the method further comprising the step of detecting the length of the documents at least in transport direction, wherein during the step of controlling, in response to a detection result during the step of detecting, when the sum of length of documents to be copied in the transport direction is below a predetermined length, the documents are moved back and forth in a transport path for repeating copying without discharging the documents to be copied and inverting of the documents is allowed for copying on both faces of the copy sheet.

Further the copying apparatus according to the invention, in a copying apparatus using a document feeder comprising:

means for containing documents in a stacked state in a predetermined order;

means for supplying which takes out documents stacked in the containing means from one of an uppermost layer or a bottommost layer sequentially one by one and transports them to an exposure region;

means for discharging which discharges documents after exposure from the exposure region to the other of the uppermost layer or the bottommost layer and stacks them in the predetermined order; and means for controlling the supplying means and the discharging means interlocked with copying operation;

wherein the documents are taken out, exposed, and discharged in a circulating manner to enable copying of a plurality of documents in the predetermined order, the copying apparatus further comprises means for detecting the length of the documents at least in transport direction, wherein the controlling means, in response to a detection result by the means for detecting, when the sum of length of documents to be copied in the transport direction is below a predetermined length, moves the documents back and forth in a transport path for repeating copying without discharging the documents to be copied.

Also the copying apparatus according to the invention, in a copying apparatus using a document feeder comprising:

means for inverting which inverts faces of a copy sheet to enable copying on both faces of the copy sheet;

means for containing documents in a stacked state in a predetermined order;

means for supplying which takes out documents stacked in the containing means from one of an uppermost layer or a bottommost layer sequentially one by one and transports them to an exposure region;

means for discharging which discharges documents after exposure from the exposure region to the other of the uppermost layer or the bottommost layer and stacks them in the predetermined order; and means for controlling the supplying means and the discharging means interlocked with copying operation;

wherein the documents are taken out, exposed, and discharged in a circulating manner to enable copying of a plurality of documents in the predetermined order, the copying apparatus further comprises means for detecting the length of the documents at least in transport direction, wherein the controlling means, in response to a detection result by the means for detecting, when the sum of length of documents to be copied in the transport direction is below a predetermined length, moves the documents back and forth in a transport path for repeating copying without discharging the documents to be copied as well as operates the inverting means to allow copying on both faces of the copy sheet.

A preferable embodiment is characterized in that means for counting is provided relating to the controlling means, which counts the number of times of the back-and-forth movement, wherein the controlling means allows the documents to be discharged once, then taken in to continue copying operation when the number of times of the back-and-forth movement counted by the counting means is above a predetermined number.

Another preferable embodiment is characterized in that the detecting means comprises a sheet detector provided for the containing means to detect a document size and a document detector provided for the feeding means to detect presence of documents, wherein the controlling means multiplies the length of a document detected by the sheet detector and the number of documents detected by the sheet detector and the document detector to obtain the sum of lengths in the transporting direction.

According to the invention, in a copying apparatus using a recirculating document feeder which takes out documents contained in the containing means in a stacked state in a predetermined order sequentially one by one from one of the uppermost layer or the bottommost layer by use of the feeding means and transports them to an exposure region, and discharges the documents after exposure to the other of the uppermost layer or the bottommost layer of the documents in the containing means by use of the discharging means thereby enabling copying of a plurality of documents in the predetermined order, means for detecting is provided to detect the length of the documents at least in a transport direction. Further the controlling means to control taking out, exposure, and discharge of the documents, in response to a detection result of the detecting means, when the sum of length of documents to be copied in the transport direction is below a predetermined length, e.g., the length of a transport path to feed the documents taken out of the containing means to the exposure region, therefore when the number of documents to be copied is relatively small, allows the documents to be copied to move back and forth in the transport path to repeat copying operation without discharging the documents to be copied.

Accordingly, the length of a transport path of documents can be drastically shortened compared to the case where the documents are once discharged to the containing means and taken in again for exposure, thereby shortening time required for copying operation.

Also according to the invention, in a copying apparatus using a recirculating document feeder described above, means for inverting the faces of a copy sheet is provided, whereby when copying a so-called simplex document the record of which on its single face is to be copied onto both faces of a copy sheet, in the case where the sum of length of documents in a transport direction is below a predetermined length, e.g., ½ of an exposure region, the documents to be copied are moved back and forth in a transport path without being discharged as well as the inverting means is operated interlocked with the back-and-forth movement, thereby enabling, e.g., copying on both faces from two simplex documents.

Therefore, in copying the first document on one face of copy sheets successively and accumulating them once in a so-called intermediate tray then copying the second document on the other face of the copy sheets, copying operation is allowed to be continued as long as copy sheets can be fed irrespective of the number of sheets that can be contained in the intermediate tray.

Also preferably, the number of times of the back-and-forth movement is counted by a counter, and when the count is above a predetermined number, documents are once discharged and taken in again to allow copying operation to continue, which enables clearance of discrepancy due to repeat back-and-forth movement for every predetermined number of times mentioned above, thereby improving quality of copy.

Further preferably, the detecting means comprises a sheet detector provided for the containing means to detect a document size and a document detector provided for the feeding means to detect presence of documents, wherein the length of a document detected by the sheet detector and the number of documents detected by the sheet detector and the document detector are multiplied to obtain the sum of lengths in the transport direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other and further objects, features, and advantages of the invention will be more explicit from the following detailed description taken with reference to the drawings which are given by way of illustration only, and thus are not limitative of the present invention, and wherein:

FIGS. 6(A)–6(G) are sectional views showing an operation in making a plurality of copies of a few number of documents;

FIGS. 9(A)–9(G) are sectional views showing an operation of still another embodiment of the invention;

DETAILED DESCRIPTION OF THE PREFERRED EMBODIMENT

Figure 1:
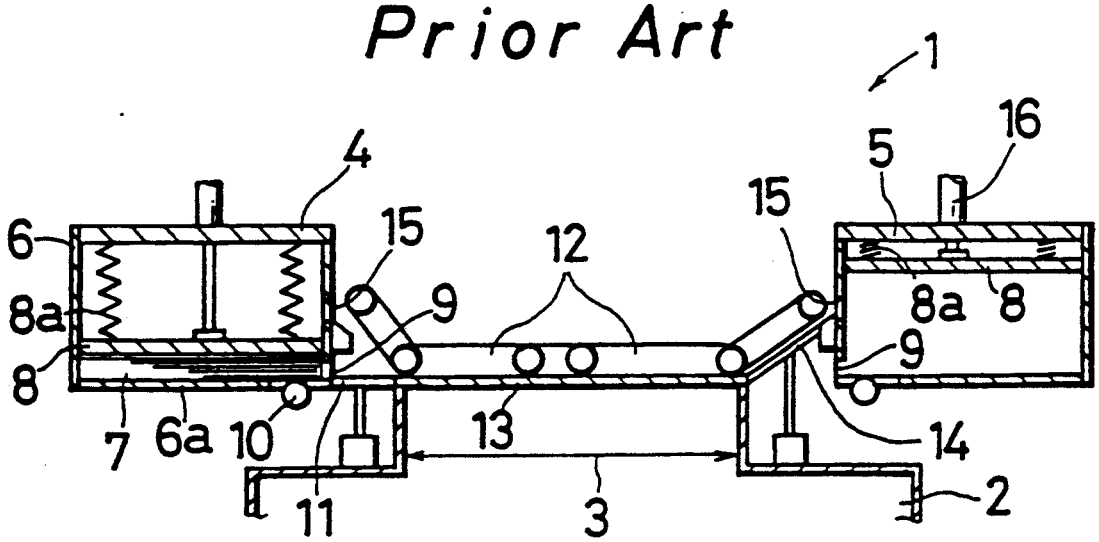
Fig. 1 Prior Art
FIG. 1 is a schematic sectional view of a typical prior art document feeder 1.
Figure 2:
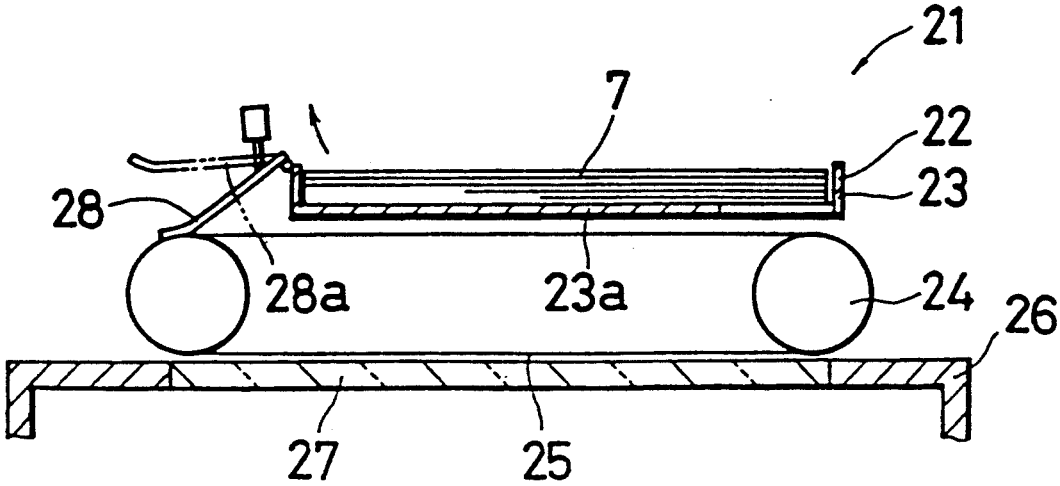
Fig. 2 Prior Art
FIG. 2 is a schematic sectional view of another prior art document feeder 21.

Now referring to the drawing, preferred embodiments of the invention are described below.

Figure 3:
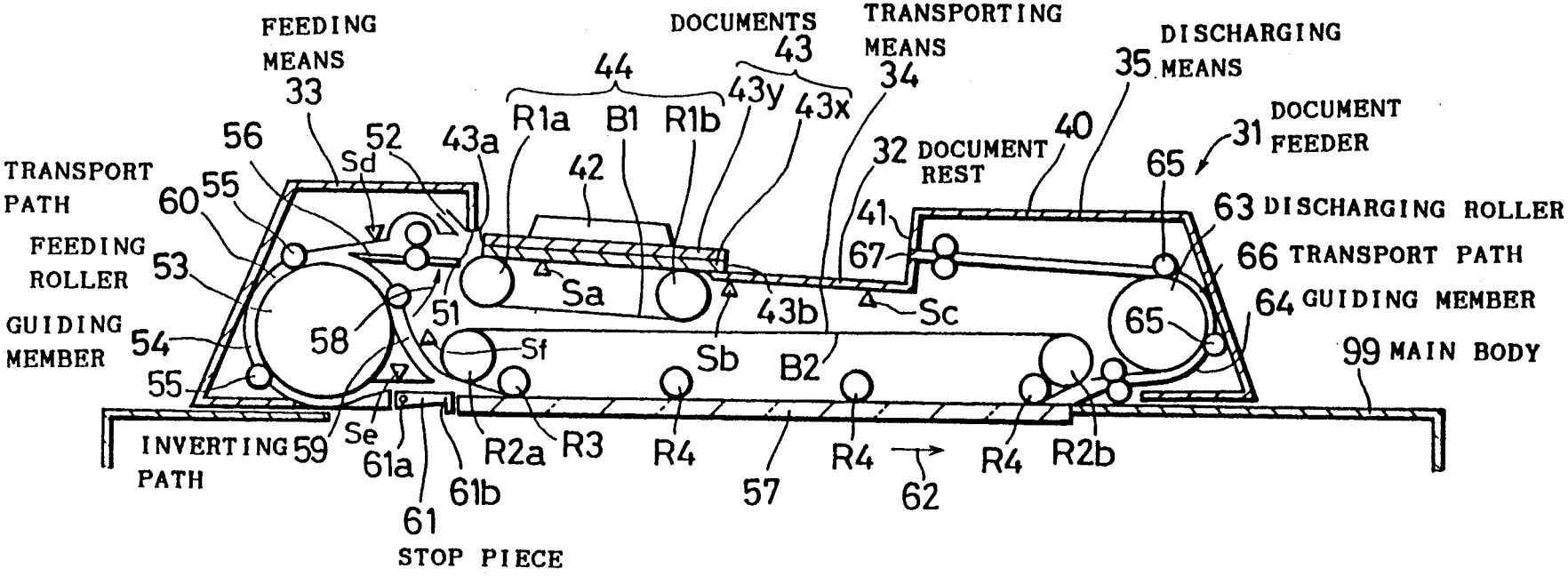
FIG. 3 is a sectional view of a document feeder 31 as a first embodiment of the invention.
Figure 4:
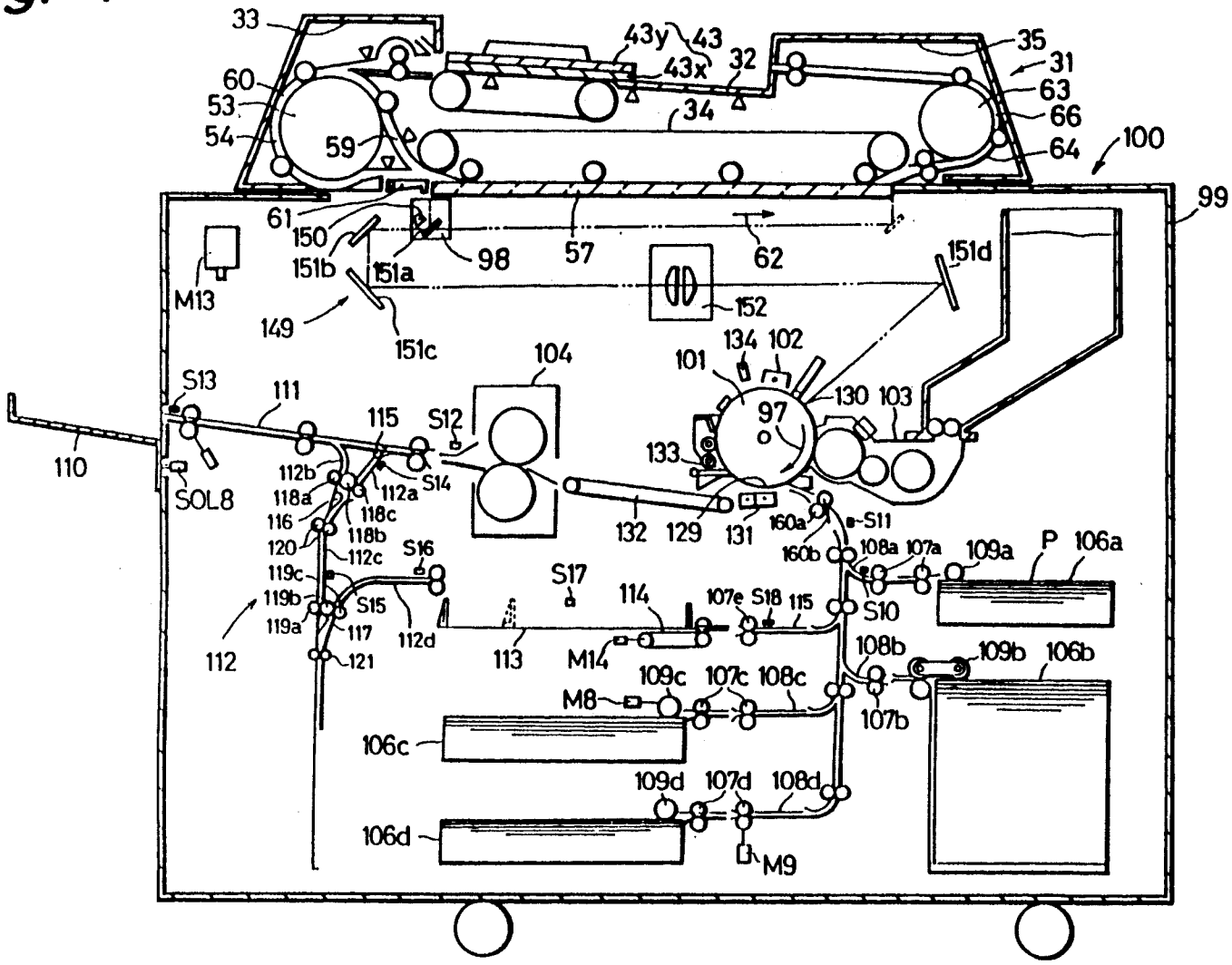
FIG. 4 is a sectional view of a copying machine 100 equipped with document feeder 31.

FIG. 3 is a sectional view of a recirculating document feeder 31 as a first embodiment of the invention, and FIG. 4 is a sectional view showing a construction of a transfer type electrostatic copying machine 100 equipped with the document feeder 31. The document feeder 31 comprises in general a document rest 32, means for feeding 33, means for transporting 34, and means for discharging 35.

The document rest 32 is composed with a side regulating plate 42 provided for a concave position 41 in a casing 40. One or plurality of documents 43 are contained in a stacked state on the document rest 32, and both ends in the width direction of the documents 43, i.e., the direction perpendicular to the sheet face in FIG. 3 are aligned by the side regulating plate 42. The size of the documents 43 placed on the document rest 32 is detected by sheet detectors Sa, Sb, and Sc. On the side of the feeding means 33 of the document rest 32, means for sending 44 is provided composed of a round endless belt B1 wound between a pair of rollers R1*a* and R1*b*.

Of the documents 43, sent from the sending means 44 of the document rest 32, with their tip 43*a* facing an intake 51 of the feeding means 33, the tip 43*a* is blown by air from an air duct 52, and only the first document 43*x* in the bottommost layer is sent to the feeding means 33 by the sending means 44.

The feeding means 33 comprises a cylindrical feeding roller 53 to transport the documents 43 inserted through the intake 51, a guiding member 54 externally surrounding the feeding roller 53 with a slight clearance left, a plurality of follower rollers 55 pressed to the peripheral surface of the feeding roller 53 to transport the documents 43 without slipping, and an inverting member 56 to invert the faces of the documents 43 as described below. The documents inserted through the intake 51, via a transport path 60 formed on the peripheral face of the feeding roller 53, are sent to the transporting means 34 situated above table glass 57 of the copying machine 100.

When the documents 43 are so-called duplex documents with an original image formed on both faces of the documents 43, the documents 43 returned from the transporting means 34 are introduced to the inverting path 59 with the feeding roller 53 inverted as well as the inverting member 56 displaced in the direction of an arrow 58, and the documents 43 are sent again onto the table glass 57 with their faces inverted. Document detectors Sd, Se, and Sf are situated on the transport path 60 and inverting path 59 in order to detect paper clogging or the like.

The transporting means 34 comprises a pair of rollers R2*a* and R2*b*, an endless belt B2 wound around between the rollers R2*a* and R2*b* facing the table glass 57 and a plurality of press roller R3 and R4 pressing the belt B2 to the table glass 57. The press roller R3 facing the feeding means 33 is displaced to and off the table glass 57 by an electromagnetic solenoid or the like.

For the main body 99 of the copying machine 100, a stop piece 61 is provided at the end on the side of the feeding means 33 of the table glass 57. The stop piece 61 is supported with its supporting point 61*a* free to swivel, and its idle end 61*b* is vertically displaced by an electromagnetic solenoid or the like in correspondence to detaching and attaching displacement of the press roller R3.

When the documents 43 are sent in from the feeding means 33, the press roller R3 is detached off the table glass 57 and the idle end 61*b* of the stop piece 61 is lowered, whereby the documents 43 are smoothly taken into the transporting means 34 and transported in the direction of an arrow 62 by the belt B2. When the documents 43 are securely taken into the transporting means 34, the press roller R3 is attachingly displaced to the table glass 57 as well as the stop piece 61 is raised. At this time, the rollers R2*a* and R2*b* are slightly inverted, and the rear end 43*b* of the documents 43 comes into contact with a stage difference face formed by the idle end 61*b* of the stop piece 61, thereby positioning the documents 43. Then the documents 43 are exposed and copied as described below. When the copying operation is completed, the documents 43 are transported in the direction of the arrow 62 and taken into the discharging means 35.

The discharging means comprises a cylindrical discharge roller 63, a guiding member 64 externally surrounding the discharge roller 63 leaving a slight clearance, and a plurality of follower rollers 65 pressed to the peripheral surface of the discharge roller 63. The documents 43 sent into the discharging means 35 are transported by the discharge roller 63, discharged onto the document rest 32 through a discharge port 67 via a transport path 66 comprising the discharge roller 63 and the guiding member 64, and placed on the uppermost layer of the stacked documents 43. In this way, the documents 43 stacked on the document rest 32 are sequentially taken in, thereby enabling an efficient copying operation.

Figure 5:
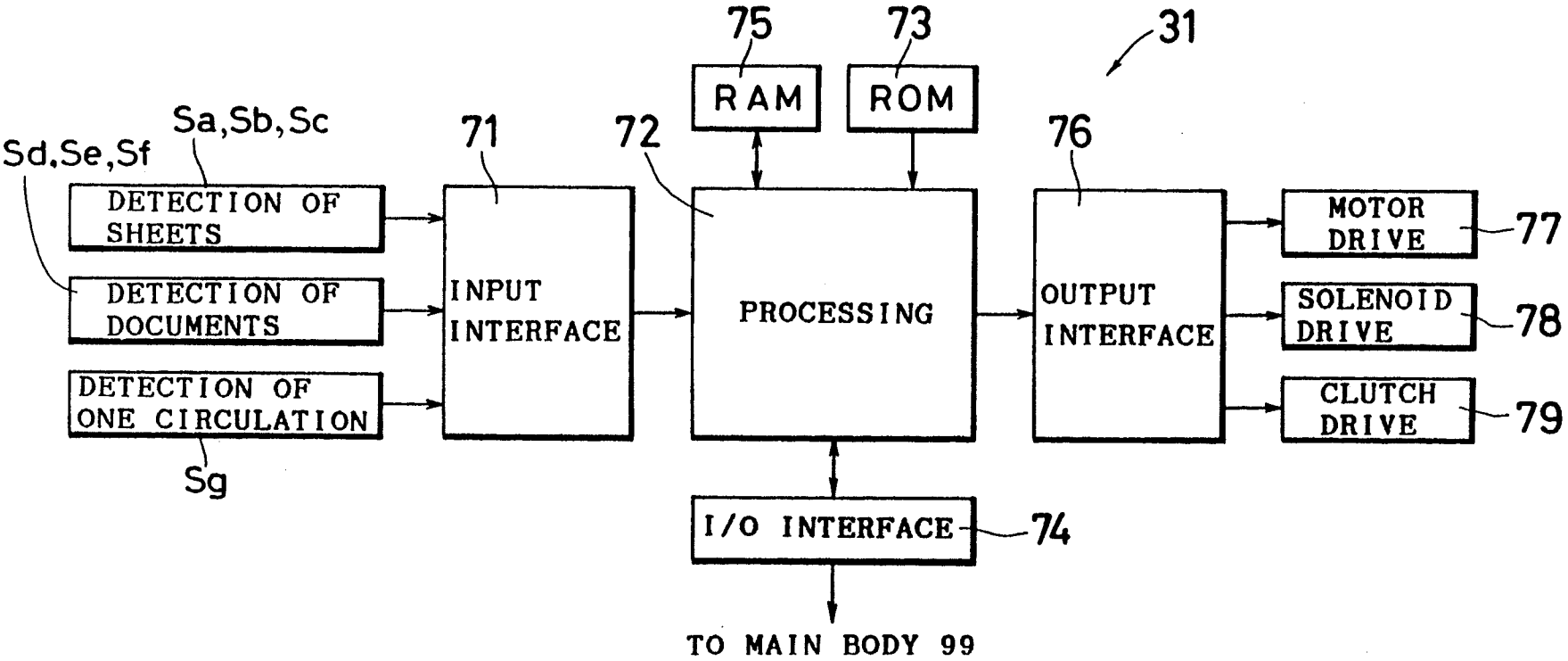
FIG. 5 is a block diagram showing an electric construction of the document feeder 31.

FIG. 5 is a block diagram showing an electric construction of the document feeder 31 constructed as described above. A detection result from the sheet detectors Sa, Sb, and Sc located at the document rest 32 and the document detectors Sd, Se, and Sf located at the feeding means are input to the processing circuit 72 including a microcomputer through an input interface circuit 71. Also, when a copying operation is started, a detection result by a circulation detector Sg facing the uppermost layer of the stacked documents 43 including a so-called micro switch is input to the processing circuit 72 via the input interface circuit 71. The circulation detector Sg, by detecting that a document which was on the uppermost layer when copying operation was started is taken into the feeding means 33, detects that the documents 43 to be copied have circulated.

The processing circuit 72 feeds the documents 43 onto the table glass 57 in accordance with a document feeding procedure stored in a Read Only Memory (abbreviated as ROM) 73, and realizes copying operation interlocked with the main body 99 via an I/O interface circuit 74. The processing circuit 72 stores a detection result by the detectors Sa, Sb, and Sc or the like in a Random Access Memory (abbreviated as RAM) 75 as well as performs a counting operation to check whether the number of the documents 43 has reached a specified number by means of the RAM 75.

Control outputs from the processing circuit 72 are output to a motor drive circuit 77, a solenoid drive circuit 78, and a clutch drive circuit 79 through an output interface circuit 76. The motor drive circuit 77 controls a motor to drive the rollers 53, 63, R1*a*, and R2*a*. The solenoid drive circuit 78 drives an electromagnetic solenoid to drivingly displace the inverting member 56 and the press roller R3. Also the clutch 79 intervenes between the rollers 53, 63, R1*a*, and R2*a* and the motor and conducts or interrupts a motor drive force to the rollers 53, 63, R1*a*, and R2*a* instantaneously in response to an output from the processing circuit 72. Further the processing circuit 72 drivingly controls the electromagnetic solenoid to raise and lower the stop piece 61 on the main body 99 side through the I/O interface circuit 74.

The document feeder 31 constructed as described above, when there are a relatively large number of documents 43 and when the size thereof is relatively large, takes out the documents 43 sequentially from the document rest 32 for exposure, then discharges onto the document rest 32 again. In this case, when the first document 43*x* is completely taken into the transporting means 34 from the feeding means 33 and positioned by the stop piece 61 or the like, the next document 43*y* is taken in by the feeding means 33, and stands by at the exit of the transport path 60 while the first document 43*x* is being exposed. Accordingly, when exposure of the first document 43*x* is completed and discharge from the feeding means 34 is started, the next document 43*y* is sent into the transporting means 34, thereby saving time for successive copying operation of the documents 43.

On the other hand, when the documents 43 are relatively small and few, relating to the documents 43 placed on the document rest 32 as shown in FIG. 6(A), the first document 43*x* in the bottommost layer is first taken into the feeding means 33 as shown in FIG. 6(B), further the first document 43*x* is sent into the transporting means 34 on the table glass 57 and positioned by the press roller R3 and the stop piece 61, meanwhile the second document 43*y*, that is a document in the uppermost layer placed on the document rest 32 since the number of the documents 43 is assumed to be two in the embodiment, is taken into the feeding means 33, thereby a so-called preparatory sheet feed is started.

Then, as shown in FIG. 6(D), while the first document 43*x* positioned in a specified exposure region W1 is being exposed, the second document 43*y* already stands by near the end of the transport path 60 of the feeding means 33, thus the preparatory sheet feed is completed. When exposure of the first document 43x is completed, the document 43x is temporarily transported in the direction of the arrow 62 as shown in FIG. 6(E), and discharged out of the exposure region W1. The second document 43y is then positioned on the exposure region W1.

When exposure of the second document 43y is thus completed, the transporting means 34 and the feeding means 33 are inverted, and the second document 43y is taken in the feeding means 33 again as shown in FIG. 6(D) as well as the first document 43x is positioned by the stop piece 61 to be charged in the exposure region W1. Then, when exposure of the first document 43x is completed, the second document 43y is charged in the exposure region W1 again as shown in FIG. 6(E), and when the operation shown by FIG. 6(D) and FIG. 6(E) is repeated for a desired number of copies, the documents 43x and 43y after exposure are sequentially discharged onto the document rest 32 from the discharging means 35 as shown in FIG. 6(F) and FIG. 6(G).

Figure 7:
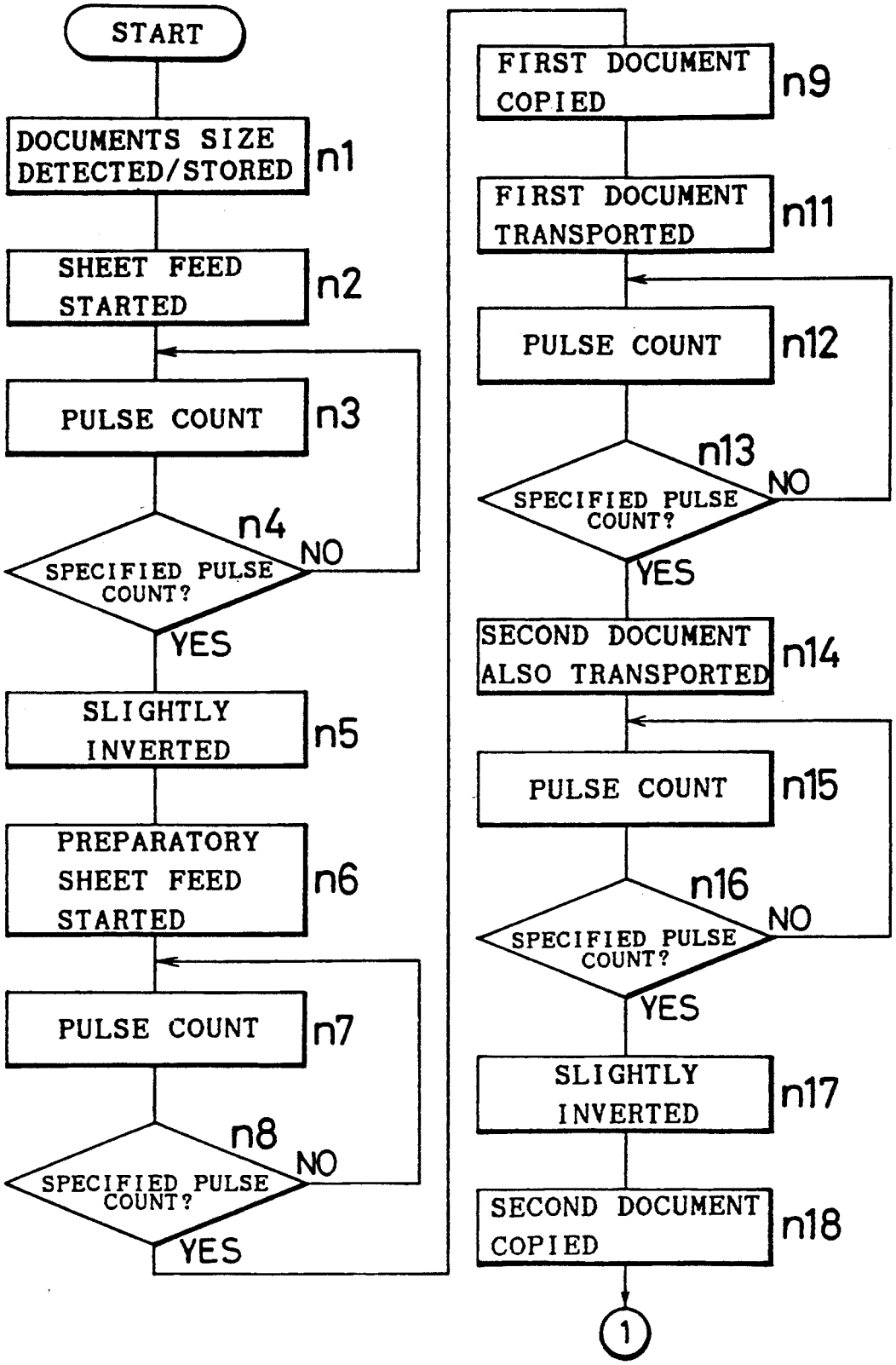
FIGS. 7A and 7(B) are flow charts showing an operation shown in the FIGS. 6(A)–6(G)
Figure 7:
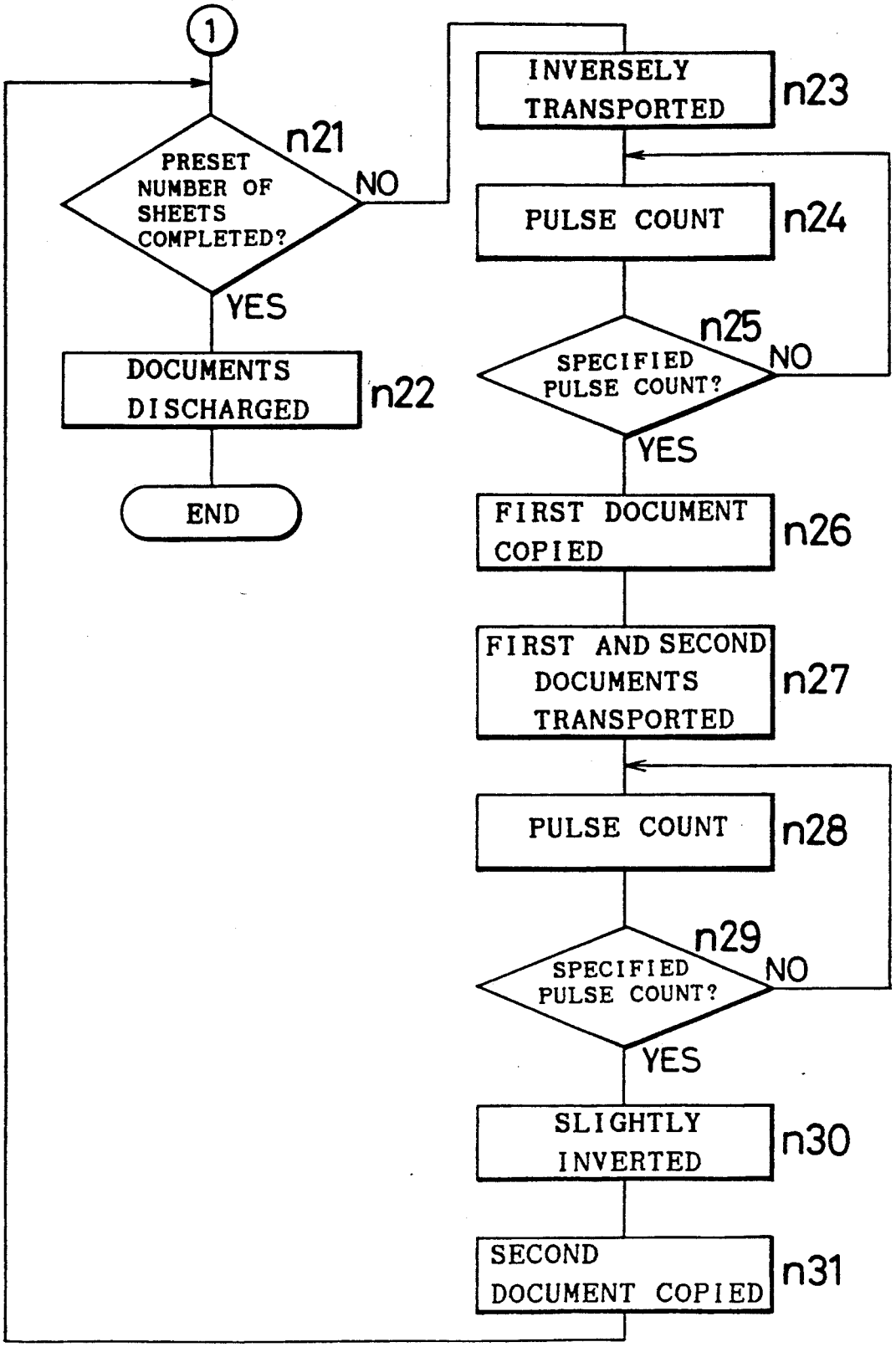

FIGS. 7(A) and 7(B) are charts showing a copying operation of a small number of documents shown in FIG. 6. In Step n1, the size of the documents 43 placed on the document rest 32 is detected by the sheet detectors Sa, Sb, and Sc, and stored in the RAM 75. In Step n2, an electromagnetic clutch and a motor for driving the rollers R1a and 53 are driven via the motor drive circuit 77 and the clutch drive circuit 79 to start sheet feeding.

The motor for driving the rollers R1a, R2a, 53, and 63 is equipped with a pulse generator, and counting pulses from the pulse generator enables detecting rotating amount of the rollers R1a, R2a, 53, and 63, i.e., transport amount of the documents 43.

Therefore, in Step n3, the pulses from a pulse generator installed on the motor for driving the rollers R2a and 53 started to be driven in the Step n2 are counted. In Step n4, it is determined whether the number of pulses counted in the Step n3 has reached a predetermined pulse count, i.e., a specified pulse count which is a pulse count corresponding to transport amount required for charging a document of a size detected in the Step n1 to the exposure region W1 plus a slight pulse count, and when it has not, control returns to Step n3 to continue transport operation, and when the number of pulses reaches the specified pulse count, control moves to Step n5.

In Step n5, the stop piece 61 is raised as well as the roller R2a is inverted for the slight pulse count, and the end 43b of the first document 43x comes into contact with the stop piece 61, whereby a charge in the specified exposure region W1 is completed. In step n6, a transport of the second document 43y, i.e., a preparatory sheet feed is started. In Step n7, transport amount of the document 43y, i.e., a pulse number of the feed roller 53 is counted, in Step n8, it is determined whether the pulse count has reached a specified pulse count corresponding to a specified standby position of the document 43y, and in the case where it has not, control returns to the Step n7, and when a preparatory sheet feed up to a specified standby position is completed, control moves to Step n9. In Step n9, a copying operation of the first document 43x is performed on the main body 99 side described later.

When a copying operation of the first document 43x is thus completed, then a transport of the document 43x in the direction of the arrow 62 is started in Step n11. In Step n12, the pulses from the pulse generator of the motor to drive the roller R2a are counted, and it is determined whether a specified pulse count is reached or not in Step n13, and if it is not, control returns to the Step n12, and when the predetermined pulse count is counted, control moves to Step n14. It enables a spacing to be kept between the first document 43x and the second document 43y corresponding to the predetermined pulse count.

In Step n14, the feeding roller 53 as well as the roller R2a is driven, thereby transporting both the documents 43x and 43y in the arrow 62 direction. In Step n15, the pulses from the pulse generator corresponding to the rollers R2a and 53 are counted. In Step n16, it is determined whether the count has reached a specified pulse count corresponding to a transport amount for the second document 43y lying in the standby position to move a predetermined slight distance along the exposure region W1, and in the case where it has not, control returns to the Step n15, and when the specified pulse count is counted control moves to Step n17. In Step n17, the roller R2a is inverted for a predetermined slight count of pulses, the document 43y is charged in the exposure region W1, and a copying operation is performed in Step n18. In Step n21, it is determined whether a copying operation of a preset number of copies is completed, and in the case where it is, control moves to Step n22, the rollers R2a and 63 are driven, and both the documents 43x and 43y are transported in the arrow 62 direction and discharged, thereby the operation is completed.

On the other hand, in the Step n21, when a copying operation of a preset number of copies is not completed, control moves to Step n23, the rollers R2a, 53, and 63 are driven in the opposite direction, and the documents 43x and 43y are both transported opposite the arrow 62 direction. In Step n24, the pulses from the pulse generator corresponding to the roller R2a are counted. In Step n25, it is determined whether a pulse count is counted corresponding to an amount of the inverted transport to the exposure region W1 of the first document 43x, and in the case where it is not, control returns to Step n24, and when the inverted transport to the specified exposure region W1 is completed, control moves to Step n26.

As for this Step n26 and after, in the same way as in the Steps n9 through n16, when a copying operation of the first document 43x is performed in Step n26, both the documents 43x and 43y are transported in the arrow 62 direction in step n27, when a count corresponding to a transport amount counted in Step n28 reaches a specified pulse count in Step 29, the document 43y is inversely transported for the slight distance in Step n30 and positioned, and when a copying operation of the document 43y is performed in Step n31, control returns to the Step n21. When a copying operation of a specified number of copies is completed by repeating Steps n23 through n31, control moves to the Step n22 and the documents 43x and 43y are discharged, then the copying operation is completed.

As is shown, in the document feeder 31 according to the invention, when the number of the documents 43 is small, the documents 43 are moved back and forth on the transport path consisting of the feeding means 33, the transporting means 34, and the discharging means 35 without being discharged onto the document rest 32, thereby allowing a copying operation in the order of stack, which results in a remarkably shortened time required for copying operation compared to the case where the documents 43 whose copying operation is over are once discharged to the document rest 32.

Whether the number of the documents 43 is small or not is determined depending on whether the rear end 43*b* of the last document 43*y* is taken in the feeding means 33 when the stacked documents 43 are sequentially taken in and the first document 43*x* faces the exposure region W1. Therefore, at the point when the last document 43*y* is taken out of the document rest 32, the processing circuit 72 multiplies the size and the number of the documents 43 to obtain the sum of lengths in a transport direction, and when the sum is below a predetermined length L1, it is determined that the number of the documents 43 is small.

More specifically, when the maximum number of the documents allowing copying operation described above is made N, it is provided by the following equation where the length in a transport direction of the documents 43 is made L2:

$$N=(L1/L2)+1, \text{ where N is an integer.}$$

The predetermined length L1 may be set either corresponding to the length of the transport path 60 in the feeding means 33 or using the length of the inverting path 59 as shown by a reference mark L1 in FIG. 6(G). Also the documents 43 from the discharge roller 63 are not circulated to the document rest 32 via the transport path 66, but may be circulated to the upper face of the belt B2 opposite the face facing the table glass 57, thereby increasing the maximum number N.

Figure 8:
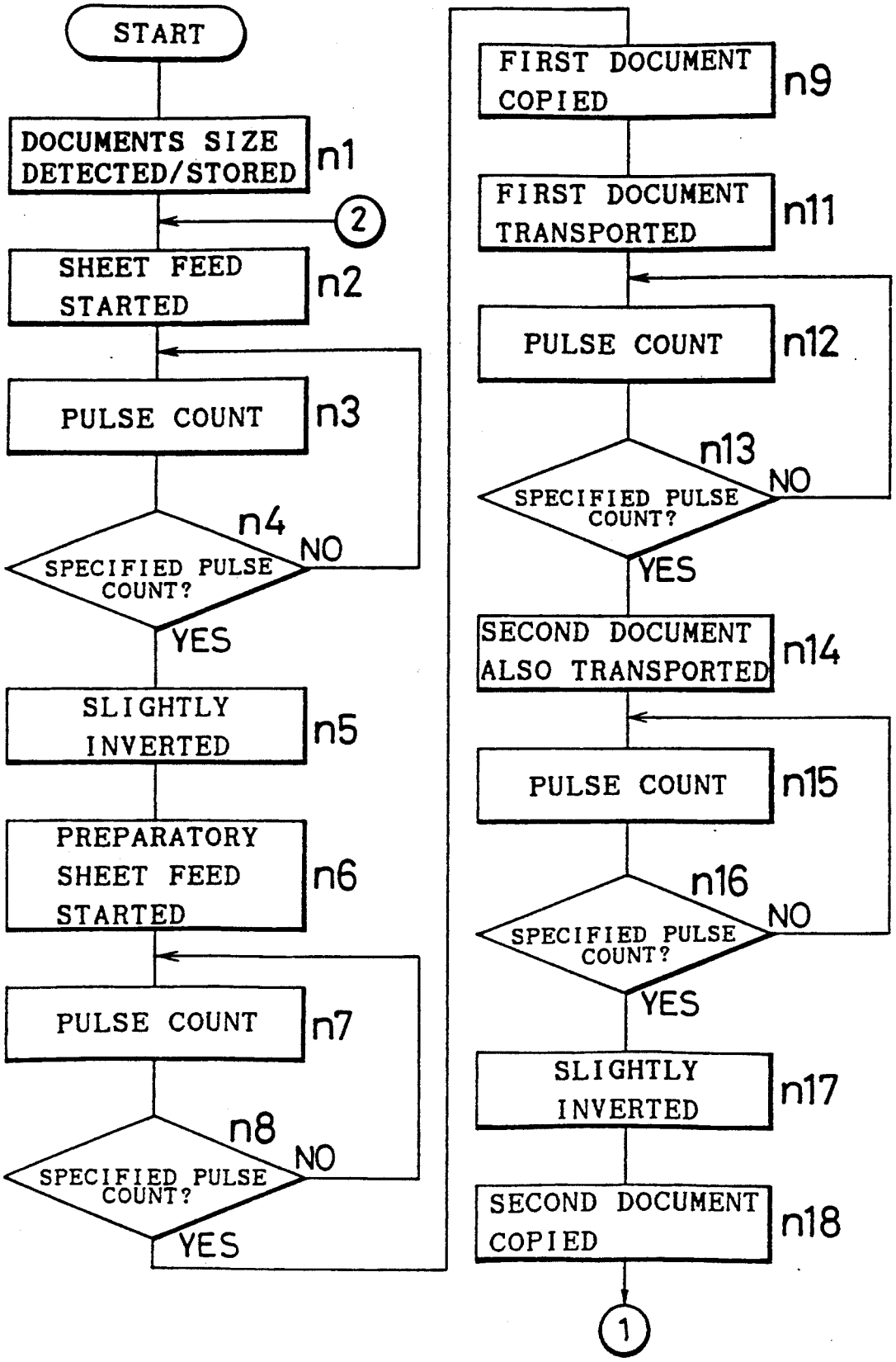
FIGS. 8(A) and 8(B) are flow charts showing an operation of another embodiment of the invention.
Figure 8:
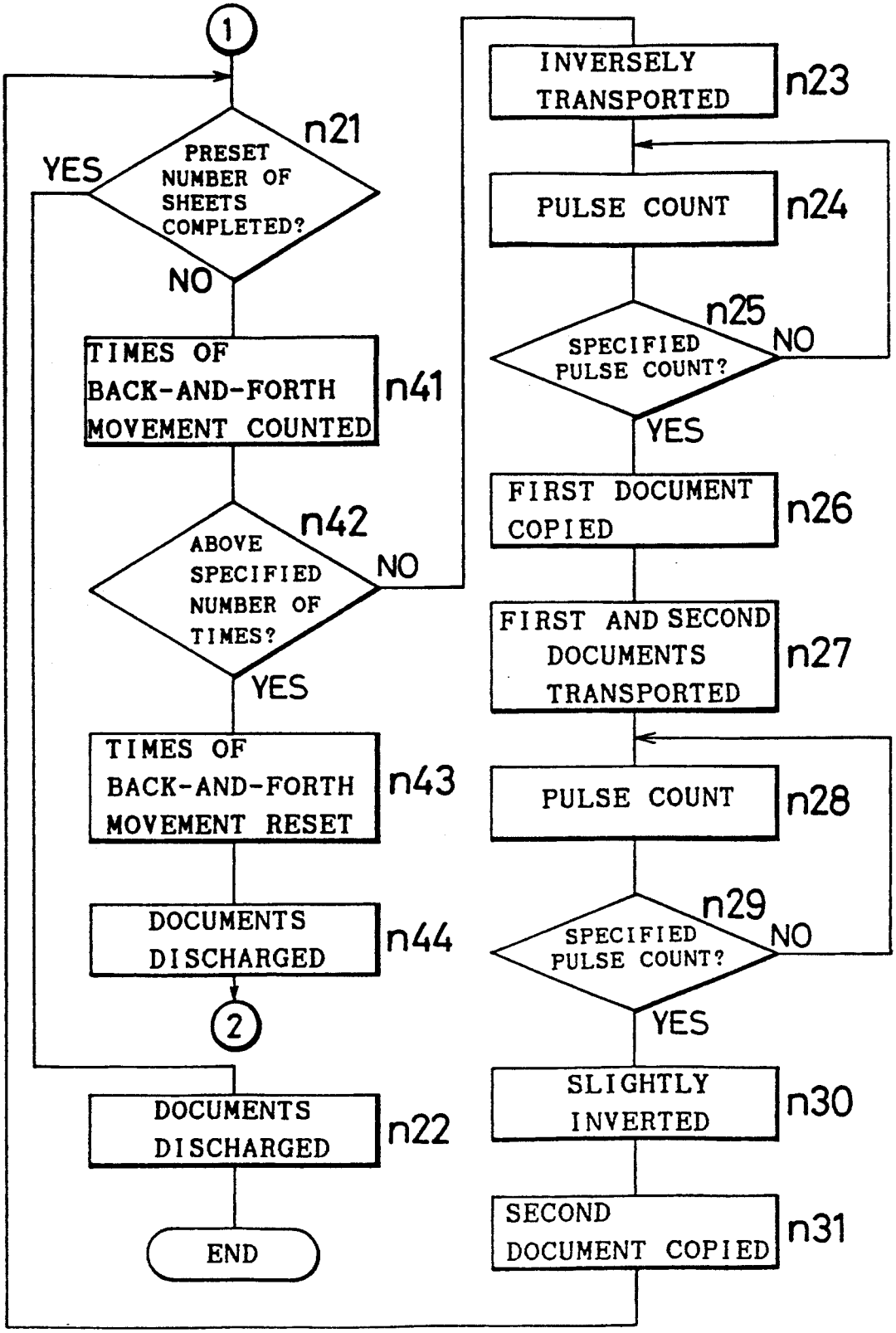

FIGS. 8(A) and 8(B) are flow charts showing an operation of another embodiment of the invention, where the embodiment is similar to the embodiment described above and the same reference numerals are attached to the corresponding parts. It should be noted in this embodiment that when a copying operation by moving the documents 43*x* and 43*y* back and forth in the exposure region W1 as shown in the FIG. 6(D) and FIG. 6(E) is performed a predetermined number of times, the documents 43*x* and 43*y* are once discharged as shown in the FIG. 6(F) and FIG. 6(G), then taken in again as shown in FIG. 6(A) through FIG. 6(D), which means that the documents 43*x* and 43*y* are once circulated to continue a copying operation.

More specifically, when a copying operation of a preset number of copies is not completed in the Step n21, control moves to Step n41, where the number of times of back-and-forth movement of the documents 43*x* and 43*y* on the exposure region W1 is counted. In Step n42, it is determined whether the number of times is above a predetermined one, and in the case where it is not, control moves to the Step n23 and after, and a copying operation by moving the documents 43*x* and 43*y* back and forth is continued, while in the case where it is, control moves to Step n43, and the count of times of the back-and-forth movement is reset, then the rollers R2*a* and 63 are driven to transport the documents 43*x* and 43*y* both in the arrow 62 direction and once discharged in step n44, then control returns to the Step n2 where a sheet feeding operation is restarted.

Thereby a so-called center misalignment of the documents 43*x* and 43*y* in the perpendicular direction for the transport direction shown by the arrow 62 and a rotational displacement named skew due to static electricity and displacement caused in transporting by the belt B2 are cleared by once circulating the documents 43*x* and 43*y*, and a copy quality is maintained in a desired allowable range as well as time required for copying operation reduced.

Referring to FIG. 4 again, facing the documents 43 placed on the exposure region W1 of the table glass 57 in the copying machine main body 99, provided is means for exposing 149. The exposing means 149 comprises a light source 150 to expose the documents 43 through a slit, reflecting mirrors 151*a*, 151*b*, 151*c*, and 151*d*, and a zooming lens 152. When the light from the light source 150 is radiated on the document image of the documents 43, the reflected light is focused on an exposure region 130 of a photosensitive member 101 via the reflecting mirrors 151*a* through 151*d* and the zooming lens 152. In the exposing means 149, a first moving body 98 equipped with the light source 150 and the reflecting mirror 151*a*, corresponding to the size of the documents 43, performs exposing and reading while scanning a reading position along the table glass 57. Such an exposing and reading operation is performed as the exposing means 149 is driven by a drive motor M13.

The photosensitive member 101 is drivingly rotated in the arrow 97 direction as well as charged by a charging corona discharger 102. The charged photosensitive member 101 is focused on the reflected light via the exposing means 149 in the exposing region 130, whereby an electrostatic latent image is formed corresponding to a read document image. The electrostatic latent image is formed into a toner image by a developing apparatus 103. The toner image is transferred by a transferring corona discharger 131 onto copy sheets P fed to the photosensitive member 101 as described below in a transfer region 129. The copy sheets P after transfer are transported to a fixing apparatus 104 by means for transporting 132, where fixing is performed.

When transfer is completed in the transfer region 129, toner remaining on the photosensitive member 101 is removed by a cleaning apparatus 133 placed downstream of the transfer region 129 in the rotating direction. Then a remaining electric charge on the photosensitive member 101 is removed by a dielectrifying apparatus 134, and after that, the surface of the photosensitive member 101 is charged by the charging corona discharger 102 in order to form an electrostatic latent image again.

On one side in the copying machine main body 99 sheet feed cassettes 106*a* and 106*b* are installed which contains the copy sheets P, and in the lower part of the main body 99, sheet feed cassettes 106*c* and 106*d* are installed. The copy sheets P contained in these sheet feed cassettes 106*a* through 106*d* in a stacked state are taken out sequentially one by one from the uppermost layer, and fed to sheet feed paths 108*a* through 108*d* respectively. The feed operation is achieved because sheet feed rollers 109*a* through 109*d* placed on the upper face of the sheet feed cassettes 106*a* through 106*d* are drivingly rotated by a sheet feed drive motor M8. On the sheet feed paths 108*a* through 108*d* and on a sheet feed path 115 from an intermediate tray 113 described below, sheet transport rollers 107*a* through 107*e* are placed respectively, and these transport rollers 107*a* through 107*e* are drivingly rotated by a drive motor M9, thereby feeding copy sheets P to a copy process part of the photosensitive member 101 or the like.

The copy sheets P transported from the sheet feed cassettes 106*a* through 106*d* and the intermediate tray 113 are controlled by registration rollers 160*a* and 160*b* installed on a transport path to the photosensitive member 101 in a timing of transport to the photosensitive member 101. More specifically, when the tip of copy sheets P in a transport direction transported to the photosensitive member 101 reaches between the registration rollers 160a and 160b, a transport of the copy sheets P is once stopped, and when the documents 43 are charged in the exposure region W1 by the document feeder 31, copy sheets P are fed interlocked with the exposing means 149 and the photosensitive member 101. Such a rotation/stop control of the registration rollers 160a and 160b is applied by an on/off control of a clutch intervening with a drive motor.

On the other side of the copying machine 99, a discharge tray 110 is located. The discharge tray 110 is equipped with a solenoid SOL8, and when the solenoid SOL8 is energized for a specified time, the discharge tray 110 is displaced to the near side of the paper of FIG. 4, and when the solenoid SOL8 is energized for a specified time next, it is displaced to the back side of the paper. It enables an operator to take out the copy sheets P provided in a plurality of pieces for a plurality of documents in an assorted state.

Correspondingly in the main body 99 provided are a discharge path 111 for discharging the copy sheets P which have passed through the fixing apparatus 104 from the copying process to the discharge tray 110 and an inverting path 112 branched from the discharge path 111. The copy sheets P, passing through the fixing apparatus 104 from the copying process, on whose one surface copying is made corresponding to a document image, are discharged to the discharge tray 110 in the three types of modes 1-3 below according to copy contents desired by the operator.

1. The copy sheets P, passing the discharge path 111 as they are, are discharged to the discharge tray 110.

2. The copy sheets P, heading for the discharge path 111, are inversely transported by the inverting path 112 for copying to be performed on the other surface thereof, then temporarily contained in the intermediate tray 113 in order to be transported to the copying process again. The copy sheets P stacked in the intermediate tray 113 are fed, sequentially from the bottommost layer, to the copying process via the transport path 115 by the feeding means 114 drivingly rotated by a motor M14, and discharged to the discharge tray 110 via the discharge path 111 from the fixing apparatus 104.

3. The copy sheets P, once heading for the discharge path 111, are inverted upside down by the inverting path 112, then discharged to the discharge tray 110.

The inverting path 112, in order to enable such a transport operation of the copy sheets P, comprises paths 112a and 112b branched from two positions on the discharge path 111, a path 112c where the paths 112a and 112b join together, and a path 112d heading for the intermediate tray 113 branched from the path 112c. A first direction changing claw 115 is situated in a portion where the path 112a is branched from the discharge path 111, a second direction changing claw 116 in a portion where the path 112a and the path 112b join together, and a third direction changing claw 117 in a portion where the path 112c and 112d are branched, in a respective manner. These first to third direction changing claws 115 through 117 are actuated respectively by solenoids not shown, by which a transport path of copy sheets P is chosen as described above according to copying contents desired by the operator.

Rollers 118a, 118b, and 118c are situated in the vicinity of a portion joining the path 112a and the path 112b, and rollers 119a, 119b, and 119c in the vicinity of a portion branching the path 112c and the path 112d, serving respectively to transport the copy sheets P. Also, inverting rollers 120 are situated along the path 112c in the vicinity of a portion joining the path 112a and the path 112b, and drivingly rotated normally and inversely by a drive motor not shown to invert a transport direction of the copy sheets P. An inverting roller 121 is situated downward of the branch portion of the path 112c and the path 112d, and drivingly rotated normally and inversely by the drive motor not shown. Further, a discharge detector S13 is situated in the vicinity of the outlet of the discharge path 111, copy sheet inversion detectors S14 and S15 in the vicinity of the outlet of the path 112a and along the path 112c, and also an intermediate tray inlet detector S16 in the vicinity of the outlet of the path 112d in a respective manner.

According to a construction of the inverting path 112 described above, in the discharge mode 1, the path 112a is closed against the discharge path 111 by the first direction changing claw 115, thereby discharging the copy sheets P along the discharge path 111. Also, in the discharge mode 2, the discharge path 111 is closed by the first direction changing claw 115 to introduce the copy sheets P to the path 112a, and the path 112c is opened by the second direction changing claw 116, and a transport direction is inverted by the inverting roller 121 on the path 112c. Then, the path 112d is opened by the third direction changing claw 117, thereby discharging the copy sheets P to the intermediate tray 113. Further, in the discharge mode 3, the copy sheets P are introduced to the path 112c as described above, then a transport direction is inverted by the inverting roller 120, and the path 112a is closed by the second direction changing claw 116 as well as the path 112b is opened, thereby leading the copy sheets P to the discharge path 111 from the path 112b.

The copying machine 100 is provided with a sheet feed detector S10 to detect a sheet feed from the sheet feed cassettes 106a through 106d, a pre-transference copy sheet detector S11, a post-fixation detector S12, an intermediate tray sheet detector S17, and an intermediate tray sheet feed detector S18 or the like in order to detect a state of a transport of the copy sheets P from the sheet feed cassettes 106a through 106d.

The copying machine 100 according to the invention provided with the recirculating document feeder 31 and having a construction for duplex copying including the inverting path 112 and the intermediate tray 113 achieves copying contents desired by the operator unrestrictedly, in both simplex and duplex copying from simplex or duplex documents with the copy sheets P assorted, by circulating the documents 43 and copy sheets P a plurality of times.

Accordingly, especially when the documents 43 are so-called simplex documents whose contents recorded on one surface only are to be copied, in a so-called page-to-page copying mode to copy two sheets of the documents 43 respectively onto both surfaces of the copy sheets P, the invention can be embodied in a preferred manner as described below. FIGS. 9(A)-9(G) are sectional view showing an operation of another further embodiment of the invention. When the size of the documents 43 is relatively large, the documents 43 are taken sequentially out of the document rest 32, exposed in a specified preset number or in a number containable in the intermediate tray 113, then discharged to the document rest 32. At this time, when positioning of the first document 43x is completed as described above, a preparatory feed of the next document 43y is performed as described above.

On the other hand, when the size of the documents 43 is relatively small, for example when the length L2 of the documents 43 in the transport direction is below ½ of the length W2 of the table glass 57 which is the maximum of the exposure region W1 (illustrated in FIG. 9(D), a duplex copying operation is performed as follows:

Of the documents 43 placed on the document rest 32 shown in FIG. 9(A), the preceding first document 43x in the bottommost layer is first taken in the feeding means 33 as shown in FIG. 9(B). Further, as shown in FIG. 9(C), when the first document 43x is sent to the transporting means 34 on the table glass 57 and is positioned by the pressroller R3 and the stop piece 61, the following second document 43y is already taken in the feeding means 33, whereby a preparatory sheet feed is started.

Then as shown in FIG. 9(D), while the first document 43x positioned in the exposure region W1 is being exposed, the second document 43y stands by near the end of the transport path 60, whereby a preparatory sheet feed is completed. When an exposure of the first document 43x is completed for the preset number of sheets or the number of sheets containable in the intermediate tray 113, the document 43x is temporarily transported in the arrow 62 direction as shown in FIG. 9(E), and discharged out of the exposure region W1 corresponding to the size of the documents 43 on the table glass 57 as well as the second document 43y is positioned in the exposure region W1.

When an exposure of the second document 43y is thus completed for the preset number of sheets or the number of sheets containable in the intermediate tray 113, the second document 43y is taken in the feeding means 33 again as well as the first document 43x is positioned by the stop piece 61 and set in the exposure region W1 as shown in the FIG. 9(D). Then, when the exposure of the first document 43x is completed, the second document 43y is set again in the exposure region W1 as shown in FIG. 9(E). When such an operation as shown in FIG. 9(D) and FIG. 9(E) is repeated for a preset number of sheets, the documents 43x and 43y after exposure are sequentially discharged onto the document rest 32 as well as the next set of documents 43xa and 43ya for duplex copying are taken in and set in the exposure region W1 as shown in FIG. 9(F) through FIG. 9(G). In the case where the preset number of sheets is larger than that of sheets containable in the intermediate tray 113, when an exposure of the final document is completed, the first document 43x is first taken in again, and copying is performed up to a preset number of sheets.

Figure 10A:
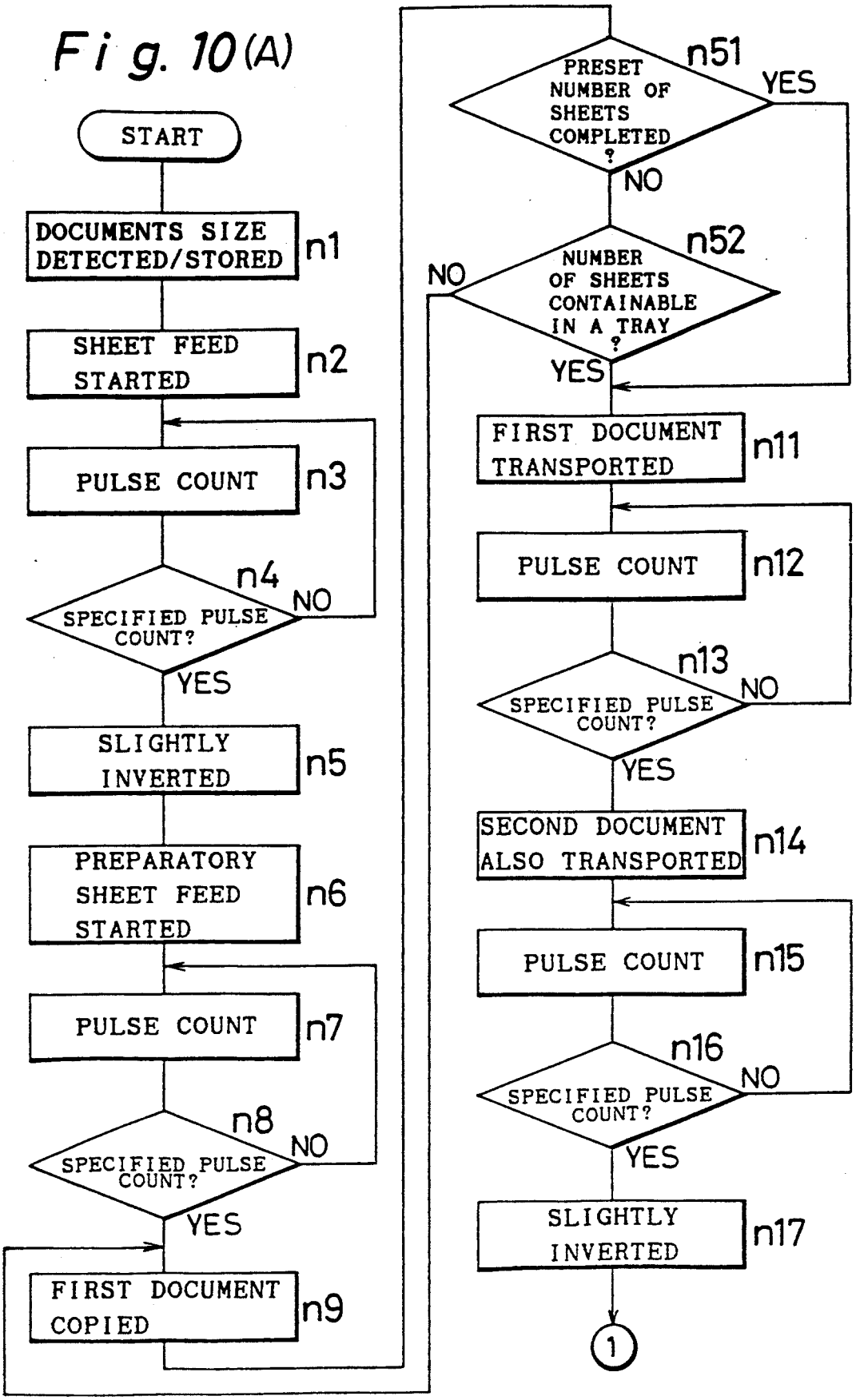
FIGS. 10(A) and 10(B) are flow charts showing an operation shown in FIGS. 9(A)–9(G) in the case of a small size of documents.
Figure 10:
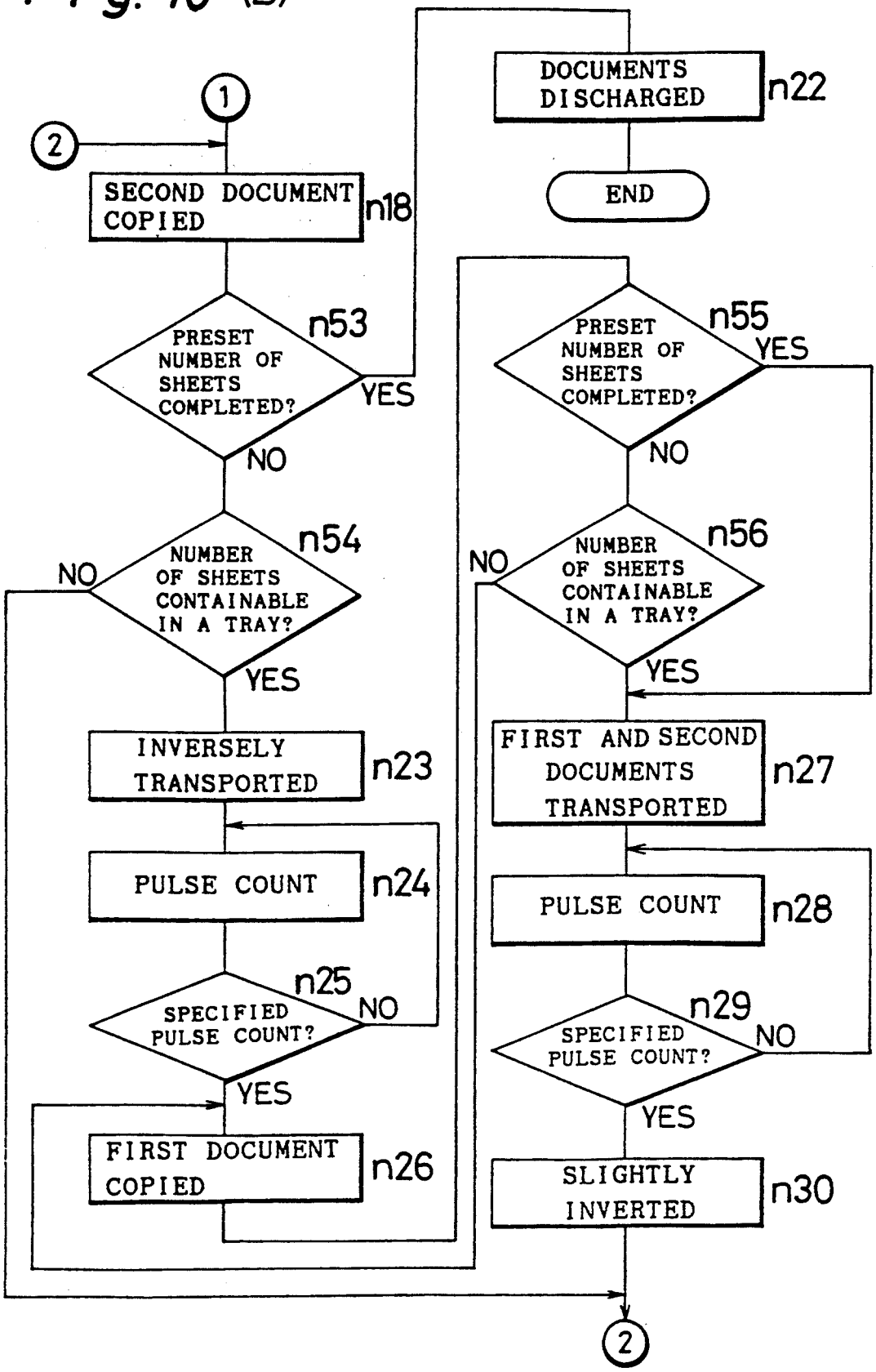

FIGS. 10(A) and 10(B) are flow charts showing the operation shown in the FIGS. 9(A)–9(G) when a size of documents is small. This embodiment is similar to one described above, and the same reference numerals are attached to the corresponding parts. The number of the documents 43 is assumed to be two in order to simplify a description. When the copying operation of the first document 43x is completed in the Steps n1 through n9, control moves to Step n51, it is determined whether a copying operation onto the copy sheets P is completed for a preset number, and in the case where it is not, it is determined whether the count of copying operations has reached the number of sheets containable in the intermediate tray 113 in Step 52, and in the case where it has not, control returns to the Step n9 and copying of the first document 43x is continued. When a copying operation of the first document 43x is completed for a preset number of sheets in the Step n51 and when the count of the copying operation has reached the number of sheets containable in the intermediate tray 113 in Step n52, control moves to the Steps n11 through n18, and the contents of the second document 43y are copied onto the copy sheets P inverted upside down fed from the intermediate tray 113.

When the copying operation is determined to have been completed for the preset number of sheets in Step n53, control moves to the Step n22, where the documents 43x and 43y are discharged to complete an operation. Also, when the copying operation is not completed in the Step n51 up to the preset number of sheets, control moves to Step n54, where it is determined whether the count of copying operations of the second document 43y has reached the number of the copy sheets P contained in the intermediate tray 113, and in the case where it has not, control returns to the Step n18, where a copying operation of the second document 43y is continued.

On the other hand, when a copying operation of the copy sheets P in the intermediate tray 113 is completed in the Step n54, which means when a preset number of sheets is larger than the number of sheets containable in the intermediate tray 113, control moves to the operation in the steps n23 through n26, where the first document 43x is set in the exposure region W1 again and a copying operation started. Then, it is determined whether a copying operation is completed up to a preset number of sheets in Step n55, and in the case where it is not, it is determined in Step n56 whether a copying operator is reached to the number of sheets containable in the intermediate tray 113, and in the case where it is not, control returns to the Step n26 and a copying operation of the first document 43x is continued. When a copying operation up to a preset number of sheets is completed in the Step n55, and when a copying operation is reached to the number of sheets containable in the intermediate tray 113 in Step n56, control moves to the operation in the Steps n27 through n30, and the second document 43y is set, then control returns to the Step n18, where a copying operation of the second document 43y is started.

In this way, a copying operation of the documents 43 can be continued up to a preset number of sheets desired without restriction by the number of sheets containable in the intermediate tray 113, which improves an operability. Also in this embodiment, when the back-and-forth movement of the documents 43x and 43y has reached a specified number of times as described above, the documents 43x, 43y may be once discharged and circulated.

The invention may be embodied in other specific forms without departing form the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A copying method using a document feeder comprising the steps of:

containing documents in a container in a stacked state in a predetermined order;

supplying documents stacked in the container from one of an uppermost layer or a bottommost layer sequentially one by one and transporting the documents to an exposure region;

discharging documents after exposure from the exposure region to the other of the uppermost layer or the bottommost layer and stacking the documents in the predetermined order; and controlling the steps of supplying and discharging interlocked with copying operation;

wherein the documents are taken out, exposed, and discharged in a circulating manner to enable copying of a plurality of documents in the predetermined order, the method further comprises the step of detecting the length of the documents at least in transport direction, wherein during the step of controlling, in response to a detection result during the step of detecting, when the sum of length of documents to be copied in the transport direction is below a predetermined length, the documents are moved back and forth in a transport path for repeating copying without discharging the documents to be copied.

2. A copying method using a document feeder provided with an invertor which inverts the faces of a copy sheet to enable copying on both faces of the copy sheets comprising the steps of;

containing documents in a container in a stacked state in a predetermined order;

supplying documents stacked in the container from one of an uppermost layer or a bottommost layer sequentially one by one and transporting the documents to an exposure region;

discharging documents after exposure from the exposure region to the other of the uppermost layer or the bottommost layer and stacking the documents in the predetermined order; and controlling the steps of supplying and discharging interlocked with copying operation;

wherein the documents are taken out, exposed, and discharged in a circulating manner to enable copying of a plurality of documents in the predetermined order, the method further comprising the step of detecting the length of the documents at least in transport direction, wherein during the step of controlling, in response to a detection result during the step of detecting, when the sum of length of documents to be copied in the transport direction is below a predetermined length, the documents are moved back and forth in a transport path for repeating copying without discharging the documents to be copied and inverting of the documents is allowed for copying on both faces of the copy sheet.

3. The copying method as claimed in claims 1 or 2 further comprising the step of counting the number of times of the back-and-forth movement, wherein the step of controlling allows the documents to be discharged once, then taken in to continue copying when the number of times of the back-and-forth movement counted is above a predetermined number.

4. The copying method as claimed in claims 1 or 2 wherein during the step of detecting a document size is detected and presence of documents is detected, wherein during the step of controlling a length of a document detected and a number of documents detected is multiplied to obtain a sum of lengths in the transporting direction.

5. A copying apparatus using a document feeder comprising:

means for containing documents in a stacked state in a predetermined order;

means for supplying which takes out documents stacked in the containing means from one of an uppermost layer or a bottommost layer sequentially one by one and transports them to an exposure region;

means for discharging which discharges documents after exposure from the exposure region to the other of the uppermost layer or the bottommost layer and stacks them in the predetermined order; and means for controlling the supplying means and the discharging means interlocked with copying operation;

wherein the documents are taken out, exposed, and discharged in a circulating manner to enable copying of a plurality of documents in the predetermined order, the copying apparatus further comprises means for detecting the length of the documents at least in transport direction, wherein the controlling means, in response to a detection result by the means for detecting, when the sum of length of documents to be copied in the transport direction is below a predetermined length, moves the documents back and forth in a transport path for repeating copying without discharging the documents to be copied.

6. A copying apparatus using a document feeder comprising:

means for inverting which inverts faces of a copy sheet to enable copying on both faces of the copy sheet;

means for containing documents in a stacked state in a predetermined order;

means for supplying which takes out documents stacked in the containing means from one of an uppermost layer or a bottommost layer sequentially one by one and transports them to an exposure region;

means for discharging which discharges documents after exposure from the exposure region to the other of the uppermost layer or the bottommost layer and stacks them in the predetermined order; and means for controlling the supplying means and the discharging means interlocked with copying operation;

wherein the documents are taken out, exposed, and discharged in a circulating manner to enable copying of a plurality of documents in the predetermined order, the copying apparatus further comprising means for detecting the length of the documents at least in transport direction, wherein the controlling means, in response to a detection result by the means for detecting, when the sum of length of documents to be copied in the transport direction is below a predetermined length, moves the documents back and forth in a transport path for repeating copying without discharging the documents to be copied as well as operates the inverting means to allow copying on both faces of the copy sheet.

7. The copying apparatus as claimed in claims 5 or 6 further comprising means for counting the number of times of the back-and-forth movement, wherein the controlling means allows the documents to be discharged once, then taken in to continue copying operation when the number of times of the back-and-forth movement counted by the counting means is above a predetermined number.

8. The copying apparatus as claimed in claims 5 or 6 wherein the detecting means comprises a sheet detector provided for the containing means to detect a document size and a document detector provided for the feeding means to detect presence of documents, wherein the controlling means multiplies the length of a document detected by the sheet detector and the number of documents detected by the sheet detector and the document detector to obtain the sum of lengths in the transporting direction.

* * * * *